US006982374B2

(12) United States Patent
Hsieh

(10) Patent No.: US 6,982,374 B2
(45) Date of Patent: Jan. 3, 2006

(54) FIXTURE FOR A DRUM PADDLE ASSEMBLY

(76) Inventor: Wu-Hong Hsieh, No. 162, Chung Shan 2dn Rd., Lu Chou City, Taipei Hsien (TW)

( * ) Notice: Subject to any disclaimer, the term of this patent is extended or adjusted under 35 U.S.C. 154(b) by 66 days.

(21) Appl. No.: 10/714,012

(22) Filed: Nov. 14, 2003

(65) Prior Publication Data

US 2005/0103185 A1 May 19, 2005

(51) Int. Cl.
*G10D 13/02* (2006.01)

(52) U.S. Cl. ..... 84/422.1; 84/422.2; 84/422.3

(58) Field of Classification Search ..... 84/422.1, 84/422.2, 422.3, 421
See application file for complete search history.

(56) References Cited

U.S. PATENT DOCUMENTS 6,188,007 B1 * 2/2001 Liao ..... 84/422.3
6,528,714 B1 * 3/2003 Liao ..... 84/422.3
6,822,150 B1 * 11/2004 Lombardi ..... 84/422.3

* cited by examiner

*Primary Examiner*—Kimberly Lockett
(74) *Attorney, Agent, or Firm*—Dellett & Walters

(57) ABSTRACT

A fixture adapted to combine with a paddle assembly includes a pair of rods threadingly extendable into opposite sides of the first distal end of the base, a pair of ribs adapted to be formed on opposite sides of the base, a pair of guiding grooves adapted to be oppositely defined in a bottom portion of the bracket of the drum stand to correspond to and receive therein the pair of ribs and a pair of notches adapted to be oppositely defined in a mediate portion of the bracket of the drum stand to correspond to and receive therein the pair of rods.

4 Claims, 6 Drawing Sheets

FIXTURE FOR A DRUM PADDLE ASSEMBLY

BACKGROUND OF THE INVENTION

1. Field of the Invention

Drum sets have been popular for many years whether used by big band orchestras, rock bands or jazz groups. However, the nature of drumming, that is, percussion, inevitably involves significant force in the striking of the bass drum. The constant impact of a foot-driven mallet on a bass drum causes very severe shake and vibration which in turn leads to loosening of components of the drum set. In particular, it is found that the drum paddle becomes unstable which makes the drummer lose concentration and as the drummer functions as the time keeper for the other musicians, the whole performance may be spoiled by the simple, undesirable effects of instability in the drum paddle.

The present invention relates to a fixture for a drum paddle assembly, and more particularly to a fixture having a pair of rods threadingly extendable into opposite sides of a first distal end of a base which is interconnected to a paddle at a second distal end of the base, a pair of ribs formed on opposite sides of the base, a pair of guiding grooves oppositely defined in a bottom portion of a bracket of a drum stand to correspond to the pair of ribs and a pair of notches oppositely defined in a mediate portion of the bracket of the drum stand such that after the ribs are received in the guiding grooves and the rods are received in the corresponding notches, the base is securely connected to the bracket of the drum stand.

2. Description of Related Art

With reference to FIG. 6, a conventional fixture structure to secure engagement between the drum paddle (60) and the drum stand (50) includes two extensions (62) respectively extending from opposite sides of the paddle (60) and having a bend (620) formed on a free end of the extension (62). The paddle (60) has a rear plate (61) pivotally connected to a distal end of the paddle (60) such that when the paddle (60) is connected to a bracket (51) of the drum stand (50), the rear plate (61) ensures that the paddle (60) receives stable support after the two bend (620) are extended into two opposite walls of the bracket (51). When the paddle (60) is to be disassembled, the two bend (620) are forced out of the two walls of the bracket (51) and then the paddle (60) is able to be pivoted relative to the drum stand (50).

Because the support to the paddle (60) only comes from the engagement between the two extensions (62) and the bracket (51), the paddle (60) may still shake when the drummer is playing the drum. That is, the support from the engagement between the two extensions (62) and the bracket (51) is not sufficient to balance the force exerted by the drummer to the drum.

To overcome the shortcomings, the present invention tends to provide an improved fixture to mitigate the aforementioned problems.

SUMMARY OF THE INVENTION

The primary objective of the present invention is to provide an improved fixture to provide a firm support to the paddle assembly having a base and a paddle having a distal end pivotally connected to a rear plate which is securely connected to the base.

In order to accomplish the foregoing objective, the fixture of the present invention includes a pair of rods threadingly extendable into opposite sides of a first distal end of a base which is interconnected to a paddle at a second distal end of the base, a pair of ribs formed on opposite sides of the base, a pair of guiding grooves oppositely defined in a bottom portion of a bracket of a drum stand to correspond to the pair of ribs and a pair of notches oppositely defined in a mediate portion of the bracket of the drum stand such that after the ribs are received in the guiding grooves and the rods are received in the corresponding notches, the base is securely connected to the bracket of the drum stand.

Other objects, advantages and novel features of the invention will become more apparent from the following detailed description when taken in conjunction with the accompanying drawings.

DETAILED DESCRIPTION OF THE PREFERRED EMBODIMENT

Figure 1:
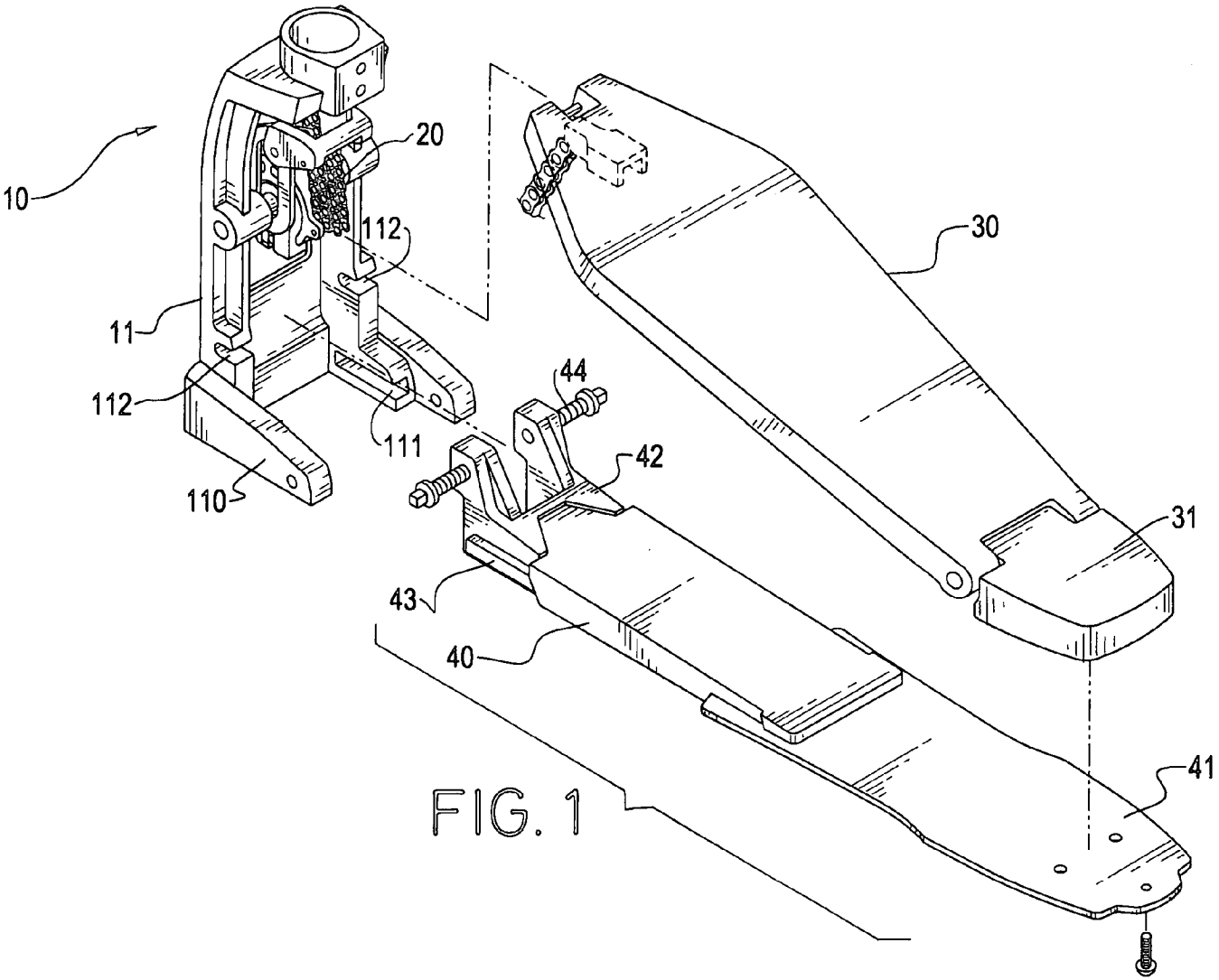
FIG. 1 is an exploded perspective view of the present invention.

With reference to FIG. 1, the fixture in accordance with the present invention is adapted to combine with a drum stand (10) which has a bracket (11) having two legs (110) extending out from the bracket (11), a paddle (30) having a first distal end connected to the drum stand (10) by a chain (20) and a base (40) having a first distal end connected to the bracket (11) and a second distal end securely connected to the paddle (30) by means of a rear plate (31) which is pivotally connected to a second distal end of the paddle (30).

The fixture of the present invention includes a pair of rods (44) threadingly extendable into opposite sides of the first distal end (42) of the base (40) which is interconnected to the paddle (30) at the second distal end (41) of the base (40), a pair of ribs (43) formed on opposite sides of the base (40), a pair of guiding grooves (111) oppositely defined in a bottom portion of the bracket (11) of the drum stand (10) to correspond to the pair of ribs (43) and a pair of notches (112) oppositely defined in a mediate portion of the bracket (11) of the drum stand (10).

Figure 2:
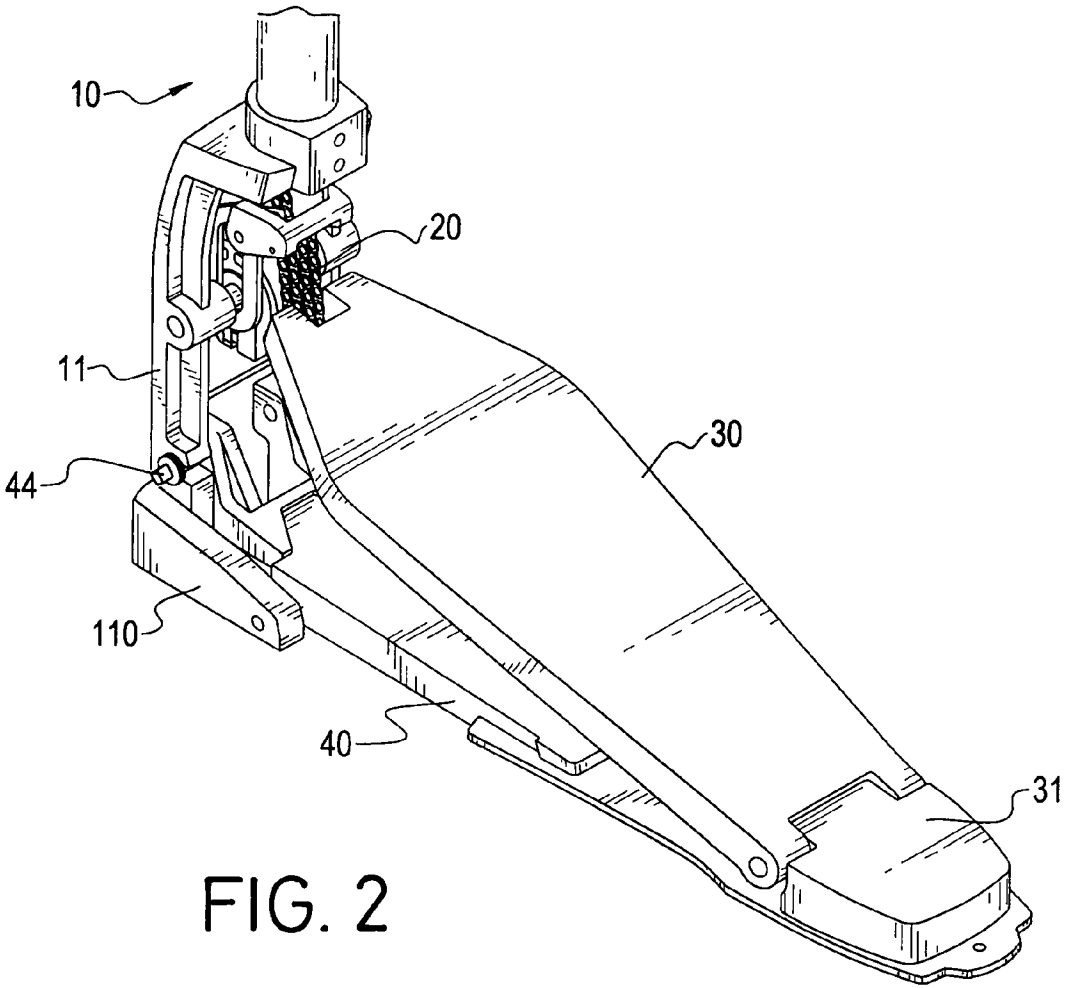
FIG. 2 is a perspective view showing the assembly of the fixture of the present invention.
Figure 3:
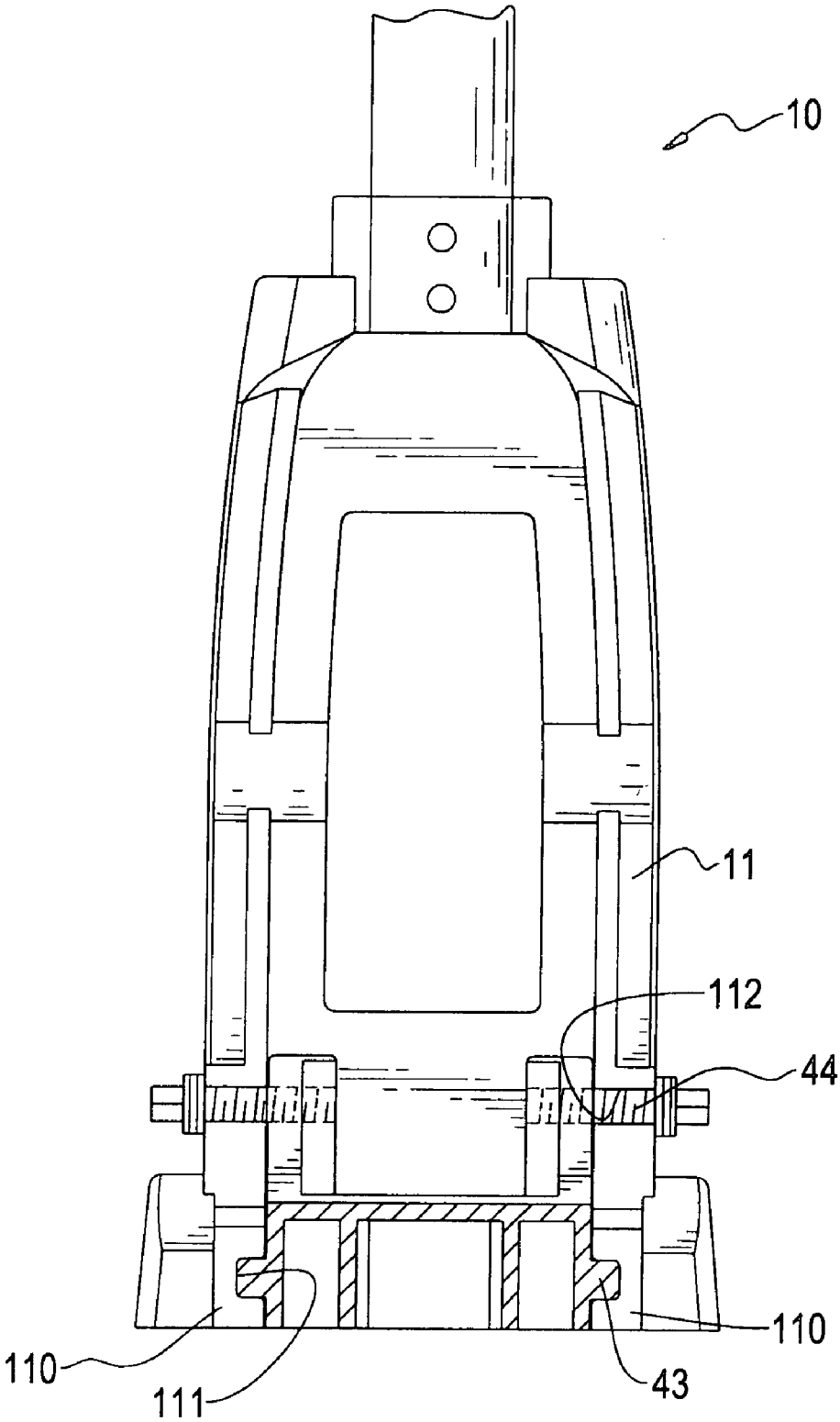
FIG. 3 is a schematic plan view showing the rods and the ribs are respectively located in position in the bracket of the drum stand.

With reference to FIGS. 2 and 3, it is to be noted that when the assembly of the fixture of the present invention is required, the ribs (43) are received in the guiding grooves (111) and the rods (44) are received in the corresponding notches (112). Then the base (40) is securely connected to the bracket (11) of the drum stand (10).

It is noted that the rods (44) preferably are threaded bolts so that the rods (44) are able to threadingly extend toward each other until the engagement between the base (40) and the bracket (11) is secured.

Figure 4:
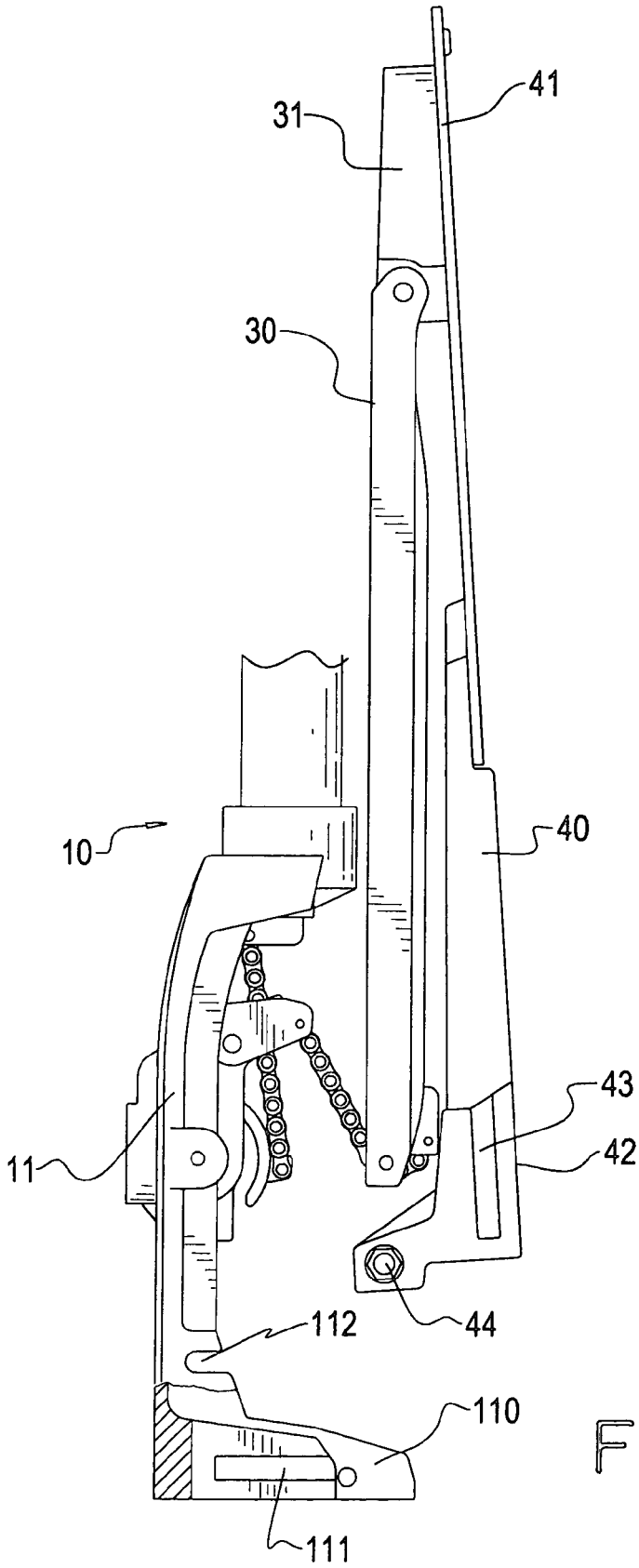
FIG. 4 is a side plan view showing the folding of the drum stand after the fixture is disassembled.

With reference to FIG. 4, when disassembly of the present invention is required, the operator is able to gradually and threadingly extend the two rods (44) away from each other to loosen the engagement between the first distal end of the base (40) and the bracket (11). Then the ribs (43) are slid out of the guiding grooves (111). Thereafter, the operator is able to fold the base (40) together with the paddle (30) relative to the drum stand (10) for easy transportation.

Figure 5:
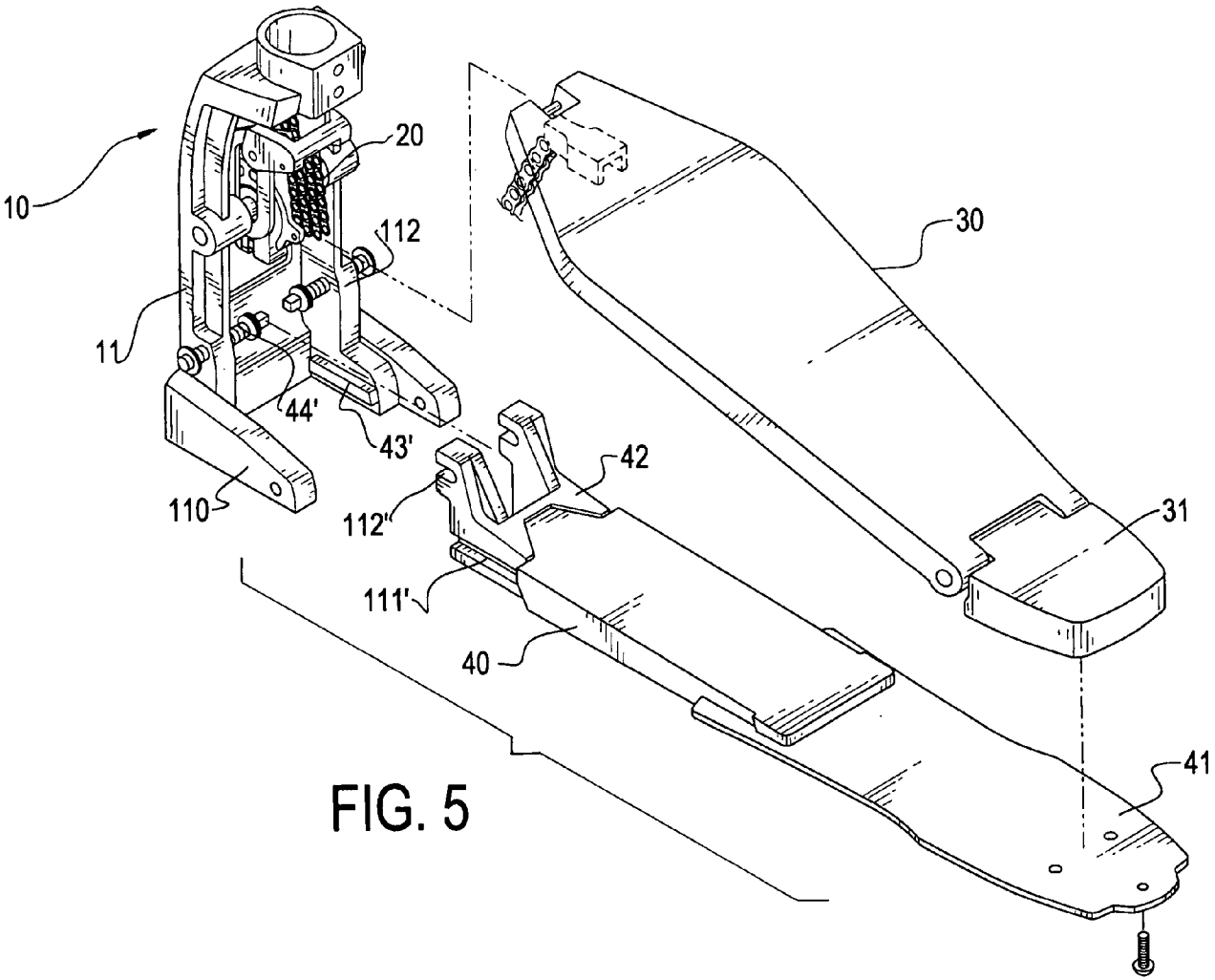
FIG. 5 is an exploded perspective view of another embodiment of the present invention.
Figure 6:
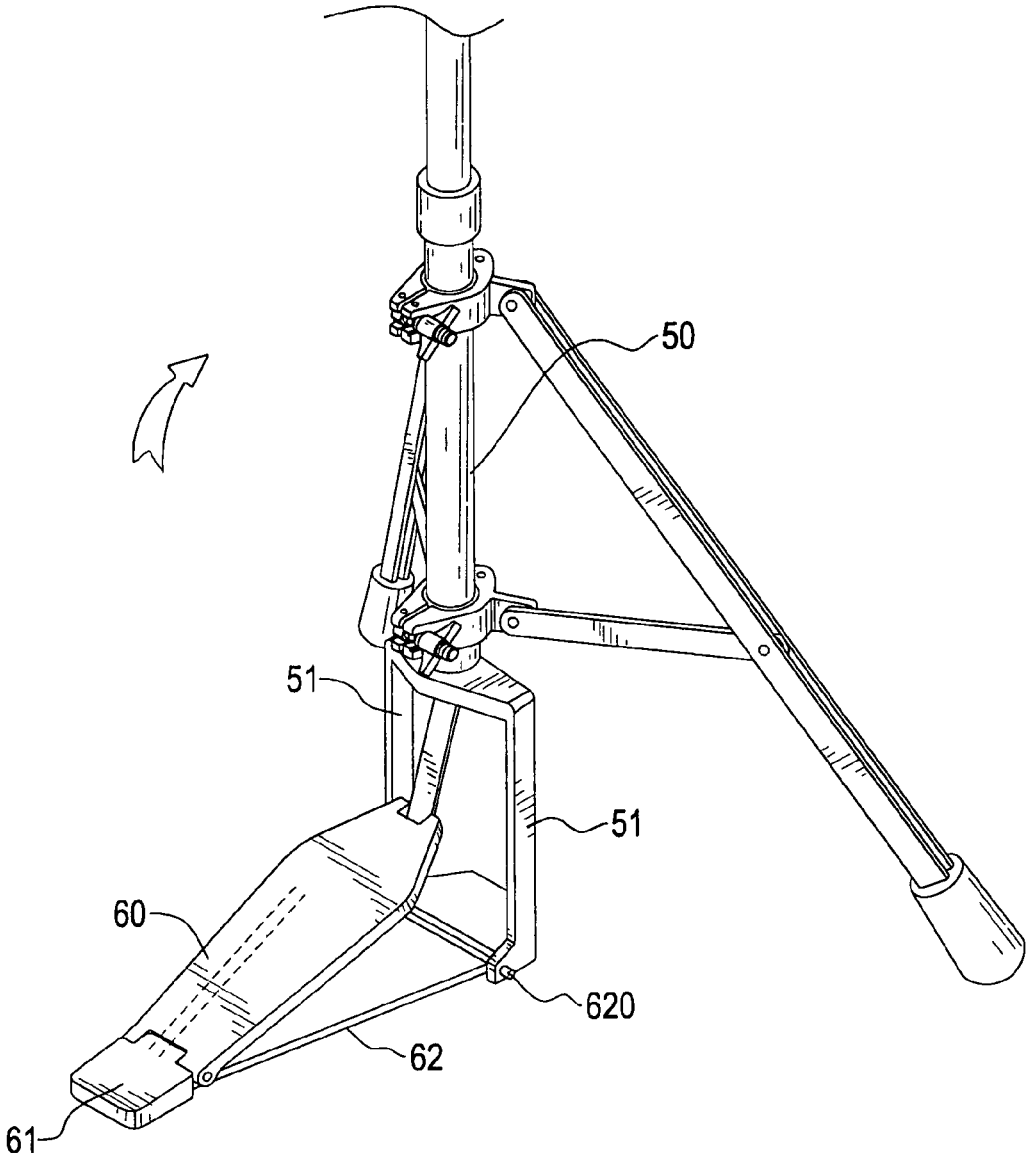
FIG. 6 PRIOR ART
FIG. 6 is a perspective view of a conventional fixture for a drum stand.

With reference to FIG. 5, it is noted that the base (40) now has a pair of guiding grooves (43') oppositely defined in a bottom portion of the base (40) and a pair of notches (44') oppositely defined in a mediate portion of the base (40). The bracket (11) of the drum stand (10) now has a pair of ribs (111') formed on a bottom portion of the bracket (11) to correspond to the ribs (43') and a pair of rods (112') formed on a mediate portion of the bracket (11) to correspond to the notches (44'). With the combination between the ribs (111') and the guiding grooves (43') and the rods (112') and the notches (44'), the fixture of another embodiment of the present invention can still accomplish the predetermined goal of securing engagement between the base (40) and the bracket (11) of the drum stand (10).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A fixture adapted to combine with a drum stand which has a bracket having two legs extending out from the bracket, a paddle having a first distal end connected to the drum stand and a base having a first distal end connected to the bracket and a second distal end securely connected to the paddle, the fixture comprising:

a pair of rods threadingly extendable into opposite sides of the first distal end of the base, a pair of ribs adapted to be formed on opposite sides of the base, a pair of guiding grooves adapted to be oppositely defined in a bottom portion of the bracket of the drum stand to correspond to and receive therein the pair of ribs and a pair of notches adapted to be oppositely defined in a mediate portion of the bracket of the drum stand to correspond to and receive therein the pair of rods.

2. The fixture as claimed in claim 1, wherein the pair of rods are threaded bolts.

3. A fixture adapted to combine with a drum stand which has a bracket having two legs extending out from the bracket, a paddle having a first distal end connected to the drum stand and a base having a first distal end connected to the bracket and a second distal end securely connected to the paddle, the fixture comprising:

a pair of guiding grooves oppositely defined in a bottom portion of the base, a pair of notches oppositely defined in a mediate portion of the base, a pair of ribs formed on a bottom portion of the bracket to correspond to and receive therein the ribs and a pair of rods formed on a mediate portion of the bracket to correspond to and receive therein the notches.

4. The fixture as claimed in claim 3, wherein the pair of rods are threaded bolts.

* * * * *